United States Patent [19]

Terauchi et al.

[11] 4,437,820

[45] Mar. 20, 1984

[54] SCROLL TYPE FLUID COMPRESSOR UNIT WITH AXIAL END SURFACE SEALING MEANS

[75] Inventors: Kiyoshi Terauchi, Isesaki; Masaharu Hiraga, Honjvo, both of Japan

[73] Assignee: Sanden Corporation, Gunma, Japan

[21] Appl. No.: 307,291

[22] Filed: Sep. 30, 1981

[30] Foreign Application Priority Data

Sep. 30, 1980 [JP] Japan ..... 55-140393[U]
Sep. 30, 1980 [JP] Japan ..... 55-140394[U]

[51] Int. Cl.[3] ..... F04C 18/02; F04C 27/00; F16J 15/16

[52] U.S. Cl. ..... 418/55; 418/142; 277/81 P; 277/81.5; 277/96.1; 277/204

[58] Field of Search ..... 418/55, 57, 59, 142; 277/81 S, 81 P, 96 R, 96.1, 204

[56] References Cited

U.S. PATENT DOCUMENTS 801,182 10/1905 Creux ..... 418/55
3,924,977 12/1975 McCullough ..... 418/55
3,994,633 11/1976 Shaffer ..... 418/55
3,994,635 11/1976 McCullough ..... 418/55
3,994,636 11/1976 McCullough et al. ..... 418/55
4,199,308 4/1980 McCullough ..... 418/55

*Primary Examiner*—John J. Vrablik
*Attorney, Agent, or Firm*—Schuyler, Banner, Birch, McKie & Beckett

[57] ABSTRACT

In a scroll type fluid compressor having an orbiting scroll member and a fixed scroll member which form at least one pair of outer fluid pockets and a central pocket therebetween for fluid compression, the axial end surfaces of each spiral element of the scroll members have a groove along the spiral curve. At least one closed portion is located along the groove to block fluid flow in the groove. A seal element is loosely fitted in the groove. During operation the compressed fluid flows into the groove to urge the seal element against the end plate of the opposite scroll member so that the axial sealing between the spiral element and the end plate is assured without leakage of fluid along the groove. Also, the closed portion is located along the spiral element at the location where the line contact point where the outer fluid pockets and the central pocket merge to prevent back pressure changes from causing excessive wear of the seal element.

7 Claims, 11 Drawing Figures

SCROLL TYPE FLUID COMPRESSOR UNIT WITH AXIAL END SURFACE SEALING MEANS

BACKGROUND OF THE INVENTION

This invention relates to a fluid displacement apparatus, and in particular, a fluid compressor unit of the scroll type.

Scroll type apparatus are well known in the prior art. For example, U.S. Pat. No. 801,182 discloses a scroll type apparatus including two scroll members each having an end plate and a spiroidal or involute spiral element. These scroll members are maintained angularly and radially offset so that both spiral elements interfit to make a plurality of line contacts between spiral curved surfaces, thereby sealing off and defining at least one pair of fluid pockets. The relative orbital motion of the two scroll members shifts the line contacts along the spiral curved surfaces to change the volume of the fluid pockets. The volume of the fluid pockets increases or decreases dependent on the direction of the orbiting motion. Therefore, this scroll type apparatus can be used to compress, expand or pump fluids.

In comparison with conventional compressors of the piston type, the scroll type compressor has certain advantages, such as a fewer parts and continuous compression of fluid. However, one of the problems with scroll type compressors is the ineffective sealing of the fluid pockets. Axial and radial sealing of the fluid pockets must be maintained in a scroll type fluid displacement apparatus in order to achieve efficient operation. The fluid pockets are defined by the line contacts between two interfitting spiral elements and axial contacts are defined by the axial end surface of one spiral element and the inner end surface of the end plate of the other spiral element.

Various techniques have been used in the prior art to resolve the sealing problem, particularly, the axial sealing problem. For example, U.S. Pat. No. 3,924,977 discloses a technique for non-rotatably supporting the fixed scroll member within the compressor housing in an axially floating condition. A high pressure fluid is introduced behind the fixed scroll member to establish sufficient axial sealing. In this technique, since the fixed scroll member is supported in an axially floating condition, the fixed scroll member may wobble due to the eccentric orbital motion of the orbiting scroll member. Therefore, sealing and resultant fluid compression tends to be imperfectly performed.

In order to avoid these disadvantages, the pressure of the high pressure fluid must be increased and the clearance between radial supporting parts must be made as small as possible. However, minimizing the clearance is expensive due to the close tolerance requirements, while an increase in pressure increases contact pressure between both scroll members, which increases mechanical loss or causes damage to the scroll members.

Another technique for improving the axial seal of the fluid pockets is to use sealing elements mounted in the axial end surface of the each spiral elements, as disclosed in U.S. Pat. No. 3,994,635. In this technique, the end surface of each spiral element facing the end plate of the other scroll member is provided with a groove formed along the spiral. A seal element is placed within the grooves and an axial force urging device, such as a spring, is placed behind the seal element to urge the seal toward the facing end surface of the end plate to thereby effect axial sealing. In this technique, the construction of the axial force urging device is complex and it is difficult to obtain the desired uniform sealing force along the entire length of the seal element.

In order to avoid these disadvantages, the seal element is loosely fitted into the groove in the axial end surface of each spiral element. As a substitute for a mechanical axial force urging device, the pressurized fluid then is introduced into the groove from adjacent fluid pockets to urge the seal element towards the facing end plate to thereby effect axial sealing. However, the seal element is subject to localized excessive wear during a portion of the orbital motion of the orbiting scroll member. That is, during the period when the pair of fluid pockets are both connected to the center high pressure space, localized fluid pressure behind the seal element is suddenly enlarged, resulting in excessive sealing force which sometimes induces localized bending of the seal element and excessive sealing force. Also, the groove in which the seal element is disposed extends from the center of the spiral element to near the terminal end thereof. Therefore, high pressure fluid flows into the groove and leaks into low pressure spaces along the groove to reduce the volumetric efficiency of the compressor.

SUMMARY OF THE INVENTION

It is a primary object of this invention to provide a scroll type fluid compressor unit with high volumetric efficiency and thus with high energy efficiency ratio.

It is another object of this invention to provide a scroll type fluid compressor unit wherein the concentrated wear of the axial seal element is prevented and the axial sealing of fluid pockets is enhanced to attain a long life.

It is still another object of this invention to accomplish the above objects with a simple construction, a simple production method, and low cost.

A scroll type fluid compressor unit according to this invention includes a pair of scroll members each comprising an end plate and a spiral wrap extending from one side of the end plate. A groove having at least one closed portion is formed in the axial end surface of each spiral wrap and extends along the spiral curve of the wrap. A seal element, which is loosely fitted in the groove, is urged against the opposite end plate by pressurized fluid which flows into the groove from adjacent fluid pockets through a gap between the seal element and the side walls of the groove. The groove has at least one closed portion which blocks the groove to prevent high pressure fluid in the central high pressure space from flowing along the groove. This closed portion in the groove minimizes excessive wear of the seal element localized at relatively central portion of the spiral. Accordingly, the axial seal between the end plate of each scroll member and the spiral wrap of each scroll member is established in a simple construction.

Further objects, features and other aspects of this invention will be understood from the detailed description of the preferred embodiments of this invention referring to the annexed drawings.

DETAILED DESCRIPTION OF THE PREFERRED EMBODIMENT

Before the preferred embodiment of this invention is described, the principle of operation of the scroll type compressor unit will be described with reference to FIGS. 1*a*–1*d*. The scroll type compressor unit operates by moving a sealed off fluid pocket from a low pressure region to a high pressure region.

Figure 1A:
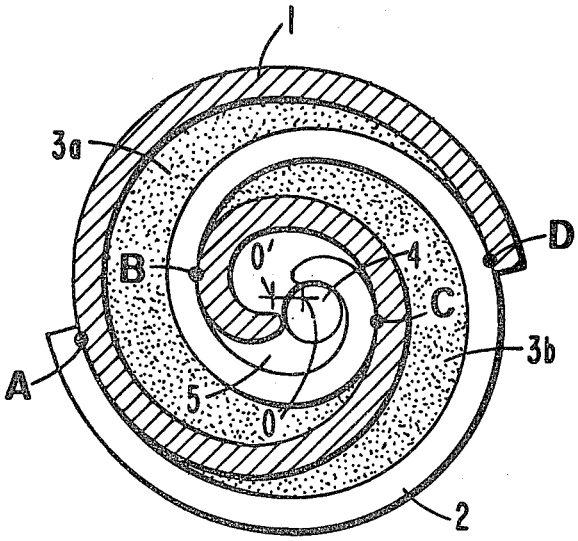
FIGS. 1*a*–1*d* are end views of spiral wraps illustrating the principle of operation of a scroll type compressor.
Figure 1B:
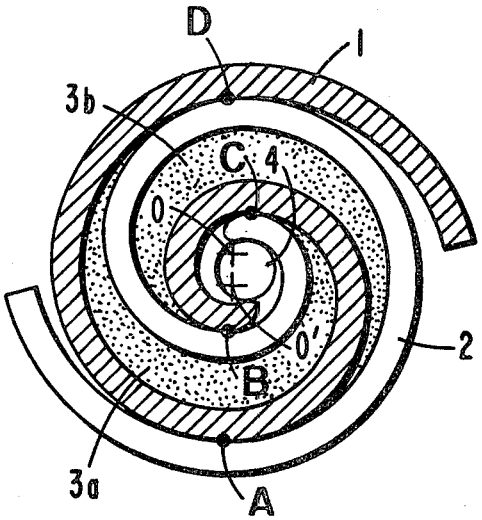

FIGS. 1*a*–1*d* are end views of the scroll members of a compressor wherein the end plates are removed to show only the spiral elements. The spiral elements 1 and 2 are angularly and radially offset and interfit to one another. As shown in FIG. 1*a*, the orbiting spiral element 1 and fixed spiral element 2 make four line contacts at four points A–D due to the radial offset of the spiral elements. A pair of fluid pockets 3*a* and 3*b* are defined between line contacts D-C and line contacts A-B as shown by the dotted regions. Fluid pockets 3*a* and 3*b* are defined not only by the walls of spiral elements 1 and 2, but also by the end plates of the scroll members from which these spiral elements extend. When orbiting spiral element 1 is moved in relation to fixed spiral element 2 so that the center 0' of orbiting spiral element 1 revolves around the center 0 of fixed spiral element 2 with a radius of 0-0', while the rotation of orbiting spiral element 1 is prevented, fluid pockets 3*a* and 3*b* shift angularly and radially towards the center of the interfitted spiral elements. This movement gradually reduces the volume of each fluid pocket 3*a* and 3*b* as shown in FIGS. 1*a*–1*d* to compress the fluid in each pocket.

Figure 1C:
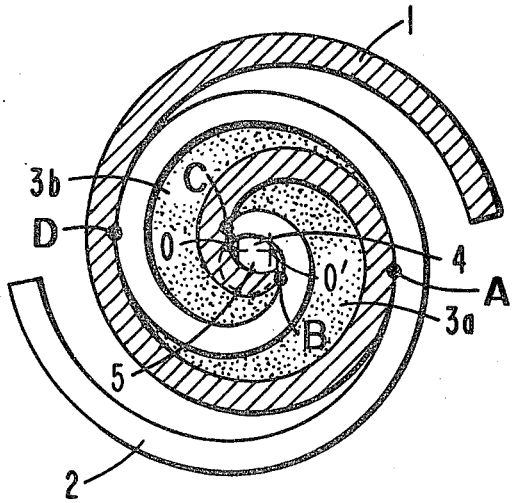
Figure 1D:
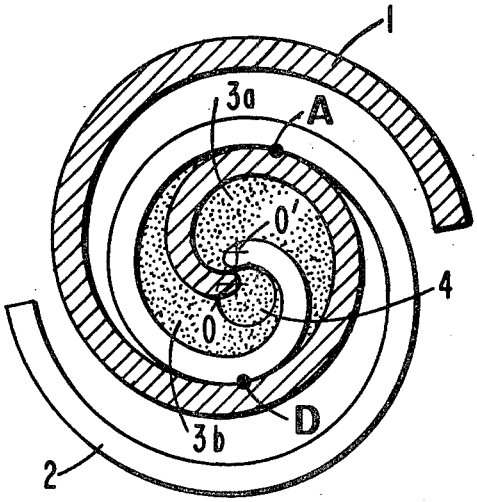

The fluid pockets 3*a* and 3*b* are connected to one another as the spiral elements move from the positions in FIG. 1*c* to the positions in FIG. 1*d*. Then, as shown in FIG. 1*a*, fluid pockets ultimately merge at the center portion and are completely connected to one another to form a single pocket 5. The volume of the single pocket 5 is further reduced by continued revolutions, as illustrated by the successive 90° revolutions of FIGS. 1*b*, 1*c* and 1*d*. The volume of the single pocket 5 is substantially zero at FIG. 1*d*. As apparent from the drawings, during the course of rotation, outer spaces occur in the state shown in FIG. 1*b* and these outer spaces change as shown in FIGS. 1*c*, 1*d* and 1*a* to form new sealed off pockets in which fluid is newly enclosed. Accordingly, if circular end plates are coupled to the axial facing end of spiral elements 1 and 2, respectively, and if one of the end plates is provided with a discharge port 4 at the center thereof as shown in FIG. 1*a*, fluid enters the spiral elements to form fluid pockets at the radial outer portions and discharges from the discharge port 4 after compression.

In order to efficiently compress the fluid, it is important that each fluid pocket be sufficiently sealed. Accordingly, in the present invention, a seal element is mounted in the axial end surface of each spiral element. This seal element is urged against the opposite end plate to form an axial seal by the pressure differential across the end surface of the spiral element.

Figure 2:
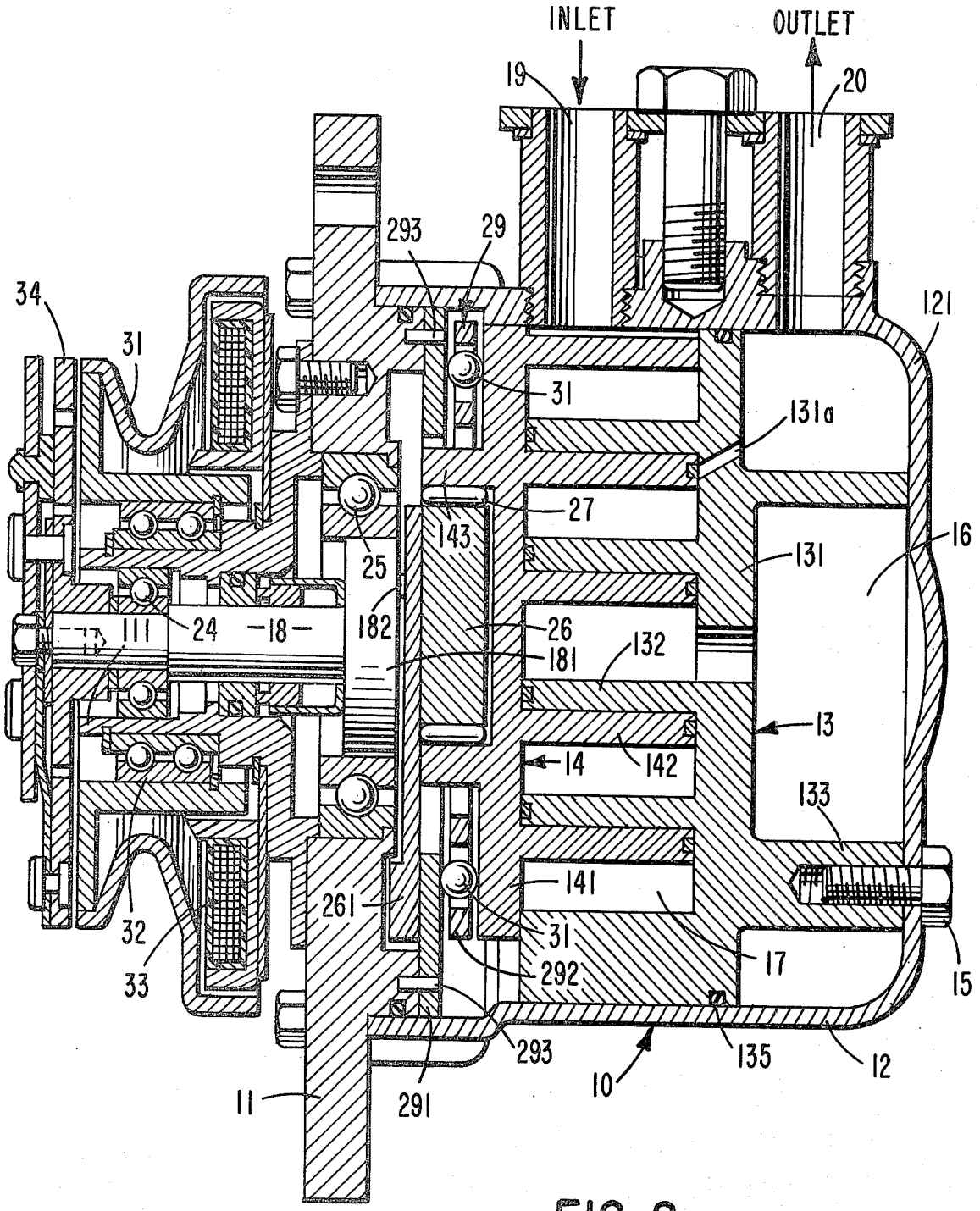
FIG. 2 is a vertical sectional view of a compressor unit in accordance with this invention.

Referring to FIG. 2, a compressor, such as a refrigerant compressor, is shown which includes a compressor housing 10 comprising a front end plate 11 and a cup shaped casing 12 disposed on the end surface of the front end plate 11. A fixed scroll member 13, an orbiting scroll member 14 and a driving and rotation preventing mechanism for the orbiting scroll member are disposed within an inner chamber of cup shaped casing 12.

Fixed scroll member 13 includes a circular end plate 131, a wrap or spiral element 132 affixed to or extending from one side surface of circular plate 131, and a plurality of internal bosses 133 axially projecting from the end surface of plate 131 on the side opposite spiral element 132. The end surface of each boss 133 is seated on the inner surface of end plate portion 121 of cup shaped casing 12 and is fixed to end plate portion 121 by bolts 15. Hence, fixed scroll member 13 is fixedly disposed within cup-shaped casing 12. Circular plate 131 of fixed scroll member 13 divides the inner chamber of cup shaped casing 12 into two chambers, such as discharge chamber 16 and suction chamber 17. A seal ring 135 is disposed between the outer peripheral surface of circular plate 131 and inner wall of cup shaped casing 13.

Orbiting scroll member 14 is disposed in suction chamber 17 of the inner chamber. It comprises a circular end plate 141 and a wrap or spiral element 142 affixed to or extending from one side surface of circular plate 141. Spiral element 142 of orbiting scroll member 14 and spiral element 132 of fixed scroll member 13 interfit at an angular offset of 180° and a predetermined radial offset to define a pair of fluid pockets. Orbiting scroll member 14 is connected to the driving and rotation preventing mechanism. This driving and rotation preventing mechanism effects orbital motion at circular radius Ro upon rotation of drive shaft 18, which is rotatably supported by front end plate 11, to thereby compress the fluid as previously described.

Figure 3:
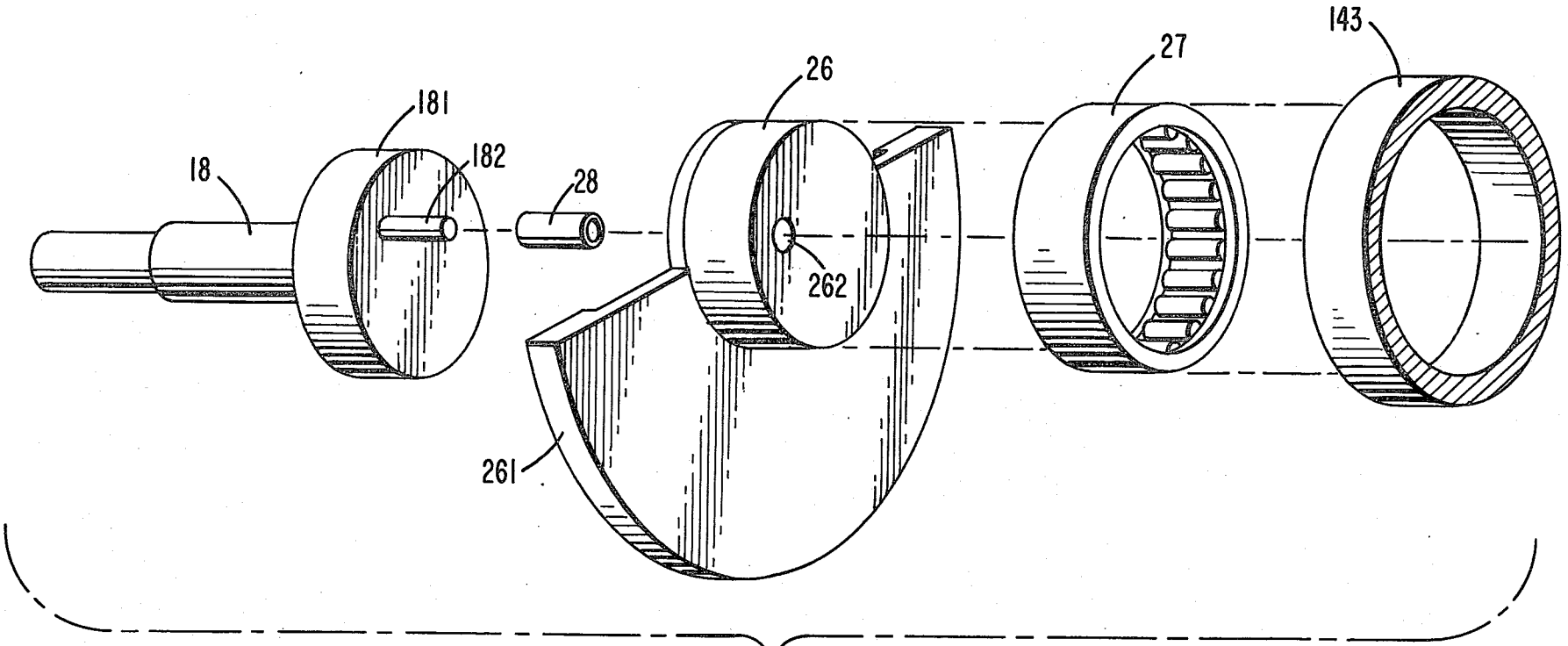
FIG. 3 is an exploded perspective view of the driving mechanism of the embodiment of FIG. 2.

Referring to FIG. 2 and FIG. 3, the driving mechanism of orbiting scroll member 14 will be described. Drive shaft 18 is rotatably supported by a sleeve portion 111 of front end plate 11, which projects from the front surface of front end plate 11, through a bearing 24. Drive shaft 18 has a disk portion 181 at its inner end portion. Disk portion 181 is also rotatably supported by front end plate 11 through a bearing 25 which is disposed within an opening of front end plate 11.

A crank pin or drive pin 182 axially projects from an end surface of disk portion 181 and is radially offset from the center of drive shaft 18. Circular plate 141 of orbiting scroll member 14 is provided with a tubular boss 143 axially projecting from an end surface opposite to the side thereof from which spiral element 142 extends. A discoid or short axial bushing 26 is fitted into boss 143 and is rotatably supported therein by a bearing means, such as a needle bearing 27. Bushing 26 has a balance weight 261 which is shaped as a portion of a disc or ring and extends radially from bushing 26 along a front surface thereof. An eccentric hole 262 is formed in bushing 26, radially offset from the center of bushing 26. Drive pin 182 is fitted into the eccentrically disposed hole 262 within which a bearing 28 may be applied. Bushing 26 is therefore driven by the revolution of drive pin 182 and permitted to rotate by needle bearing 27.

A pulley 31 is rotatably supported by a bearing 32. Bearing 32 is disposed on the outer surface of sleeve portion 111. An electromagnetic annular coil 33 is fixed to the outer surface of sleeve portion 111 and is received in an annular cavity of pulley 31. An armature plate 34 is elastically supported on the outer end of drive shaft 18 which extends from sleeve portion 111. A magnetic clutch comprising pulley 31, magnetic coil 33 and armature plate 34 is thereby formed. Thus, drive shaft 18 is driven by an external drive power source, for example, a motor of a vehicle, through a rotation force transmitting means, such as the magnetic clutch.

Now, the rotation of orbiting scroll member 14 is prevented by a rotation preventing/thrust bearing means 29 which is disposed between the inner surface of the housing 10 and circular plate 141 of the orbiting scroll member, whereby orbiting scroll member 14 orbits while maintaining its angular orientation relative to the fixed scroll member.

Figure 4:
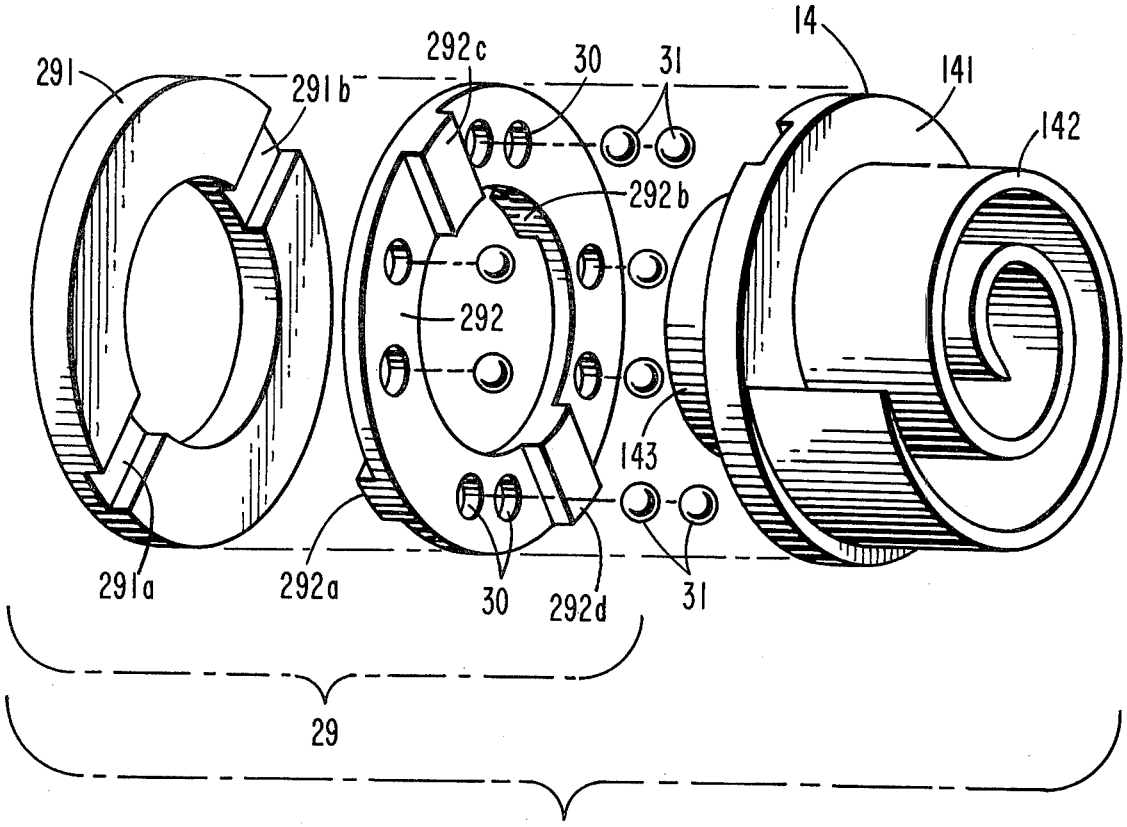
FIG. 4 is an exploded perspective view of the rotation preventing/thrust bearing mechanism of the embodiment of FIG. 2.

Referring to FIG. 4 and FIG. 1, rotation preventing/-thrust bearing means 29 will be described. Rotation preventing/thrust bearing means 29 is disposed to surround boss 143 and is comprised of a fixed ring 291 and a sliding ring 292. Fixed ring 291 is secured to an end surface of front end plate 11 by pins 293. Fixed ring 291 is provided with a pair of keyways **291*a*, 291*b* in an axial end surface facing orbiting scroll member 14. Sliding ring 292 is disposed in a hollow space between fixed ring 291 and circular plate 141 of orbiting scroll member 14. Sliding ring 292 is provided with a pair of keys 292*a*, 292*b* on the surface facing fixed ring 291, which are received in keyways 291*a*, 291*b*. Therefore, sliding ring 292 is slidable in the radial direction by the guide of keys 292*a*, 292*b* within keyways 291*a*, 291*b*. Sliding ring 292 is also provided with a pair of keys 292*c*, 292*d* on its opposite surface. Keys 292*c*, 292*d* are arranged along a diameter perpendicular to the diameter along which keys 292*a*, 292*b* are arranged. Circular plate 141 of orbiting scroll member 14 is provided with a pair of keyways (in FIG. 4 only one of keyways 141*a* is shown; the other keyway is disposed diametrically opposite to keyway 141*a*) on a surface facing sliding ringe 292 in which are received keys 292*c*, 292*d*. Therefore, orbiting scroll member 14 is slidable in a radial direction by the guide of keys 292*c*, 292*d* within the keyways of circular plate 141**.

Accordingly, orbiting scroll member 14 is slidable in one radial direction with sliding ring 292, and is slidable in another radial direction independently. The second direction is perpendicular to the first direction. Therefore, orbiting scroll member 14 is prevented from rotating, but is permitted to move in two radial directions perpendicular to one another.

In addition, sliding ring 292 is provided with a plurality of pockets or holes 30 which are formed in an axial direction. A bearing means, such as balls 31, each having a diameter which is longer than the thickness of sliding ring 292, are retained in pockets 30. Balls 31 contact and roll on the surface of fixed ring 291 and circular plate 141. Therefore, the axial thrust load from orbiting scroll member 14 is supported on fixed ring 291 through bearing means 31.

Thus, when orbiting scroll member 14 is allowed to undergo the orbital motion of a radius Ro by the rotation of drive shaft 18, fluid or refrigerant gas, introduced into suction chamber 17 from an external fluid circuit through inlet port 19 on casing 12 is drawn into the fluid pockets formed between both spiral elements 132, 142. As orbiting scroll member 14 orbits, the fluid in the fluid pockets is moved to the center of the spiral elements 132, 142 with a consequent reduction of volume. Compressed fluid is discharged into discharge chamber 16 from the fluid pocket at the center of the spiral element through a hole 134 which is formed through circular plate 131 of fixed scroll member 13 at a position near the center of spiral element 132, and therefrom, is discharged through an outlet port 20 on casing 12 to an external fluid circuit, for example, a cooling circuit.

Figure 5:
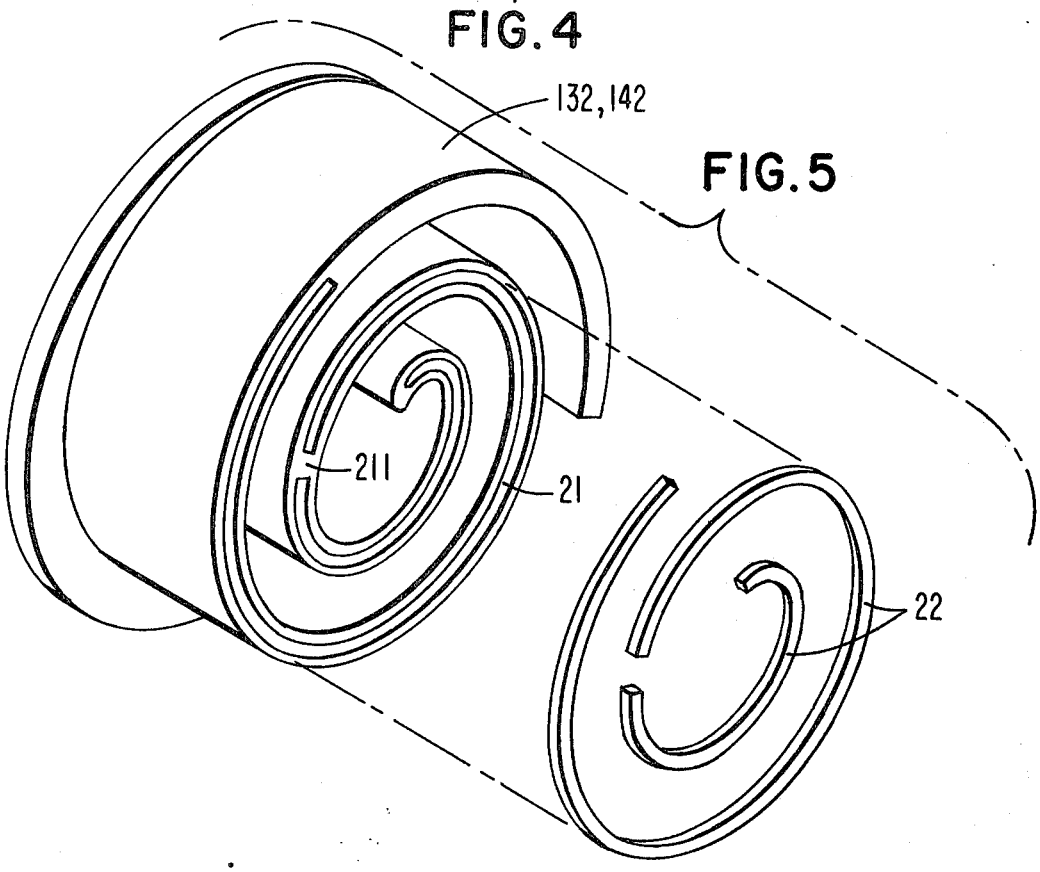
FIG. 5 is a perspective view of a scroll member according to this invention.
Figure 6:
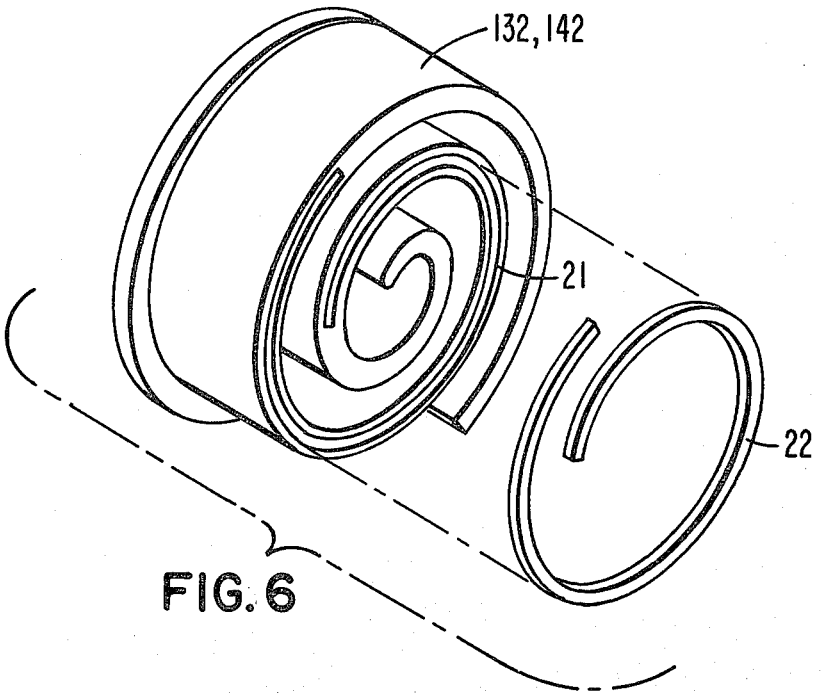
FIG. 6 is a perspective view similar to FIG. 3 of another embodiment.
Figure 7:
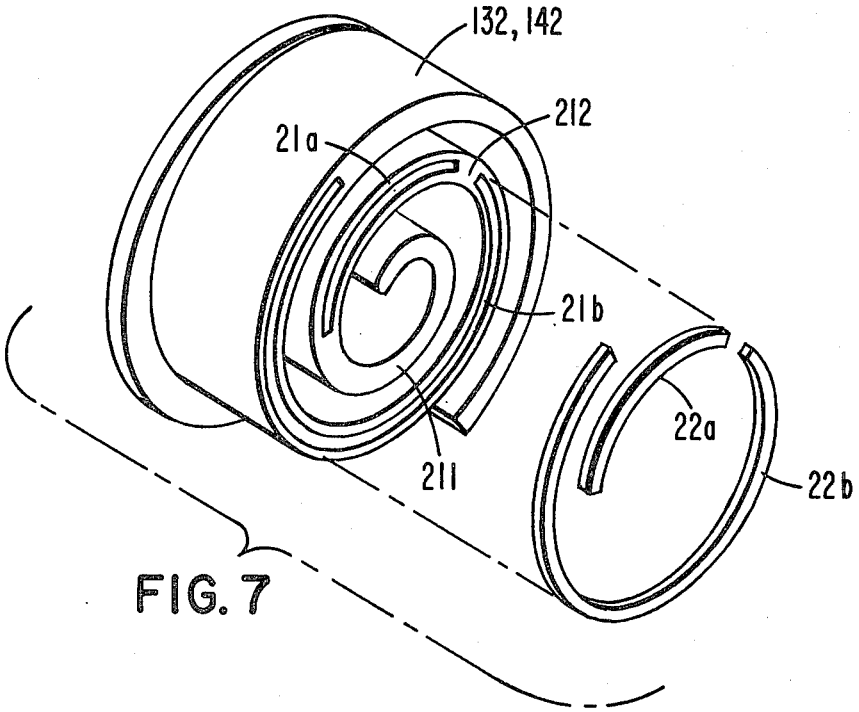
FIG. 7 is a perspective view similar to FIG. 3 of still another embodiment.

Referring to FIGS. 5–7, each spiral element 132, 142 is provided with a groove 21 formed in its axial end surface along the spiral curve. Groove 21 extends from the inner end portion of the spiral element to a position close to the terminal end of the spiral element. The groove 21 has at least one closed portion or land 211 for blocking groove 21. A seal element 22 is loosely fitted within groove 21. A hollow space is maintained between the groove and the seal element adjacent a wall of groove 21. This hollow space is connected to adjacent fluid pockets formed between interfitting scroll members 13 and 14 through two gaps, one gap is between the opposing circular end plate and the axial end surface of the spiral element and the other gap is between seal element 22 and the side walls of groove 21. Therefore, when the orbiting scroll member is driven, the compressed fluid flows from adjacent fluid pockets into the hollow space to urge seal element 22 into contact with the opposite circular plate so that the seal between the spiral element and the circular plate is effected. The above sealing technique is used on both the orbiting scroll member 14 and the fixed scroll member 13.

Now, as shown in FIG. 5, it is desirable that at least one closed portion 211 of groove 21 should be located at a point along the spiral element corresponding to line contact point A of FIG. **1*d*. At such a point, the small central pocket 5, which is best shown in FIG. 1*c*, merges with the fluid pockets 3(*a*) and 3(*b*) to begin formation of a new central pocket which is larger in volume than the ultimate volume of the central pocket at the moment when sealing contacts B and C (shown in FIG. 1) disappear. A sudden increase in pressure occurs in the new central pocket adjacent line contact point A at the moment these pockets merge because of the high pressure in the small central pocket before merger occurs. The closed portion 211 minimizes the effect of back pressure on the seal element 22 due to disconnection of high pressure in the space between seal element and bottom of the groove, which prevents deformation and bending of the seal element 22. Also, the closed portion 211** blocks the flow of high pressure fluid along the groove from the new central pocket to the outer extremities of the spiral element to thereby minimize high pressure fluid leakage.

Another embodiment is shown in FIG. 6 in which closed portion 211 extends from line contact point A of FIG. **1*d*, as described above, to the inner portion of groove 21. In other words, the part of the groove 21 shown in FIG. 5 which extends from the line contact point where the pockets merge to the inner end is eliminated. As a result, the differential pressure between the high pressure of the central pocket at the center of the spiral element and outer fluid pockets does not directly act on seal element 22. This prevents the concentrated wear of seal element 22 along the portion of the spiral element where the greatest wear could occur. Also, as indicated above with respect to FIG. 5, the elongated closed portion 121 blocks the flow of high pressure fluid along the groove from the central pocket to the outer extremities of the spiral element. Although some fluid loss occurs because of the elimination of part of the seal element 22**, this loss is counterbalanced by the blocking of the flow of fluid along the groove itself.

Figure 8:
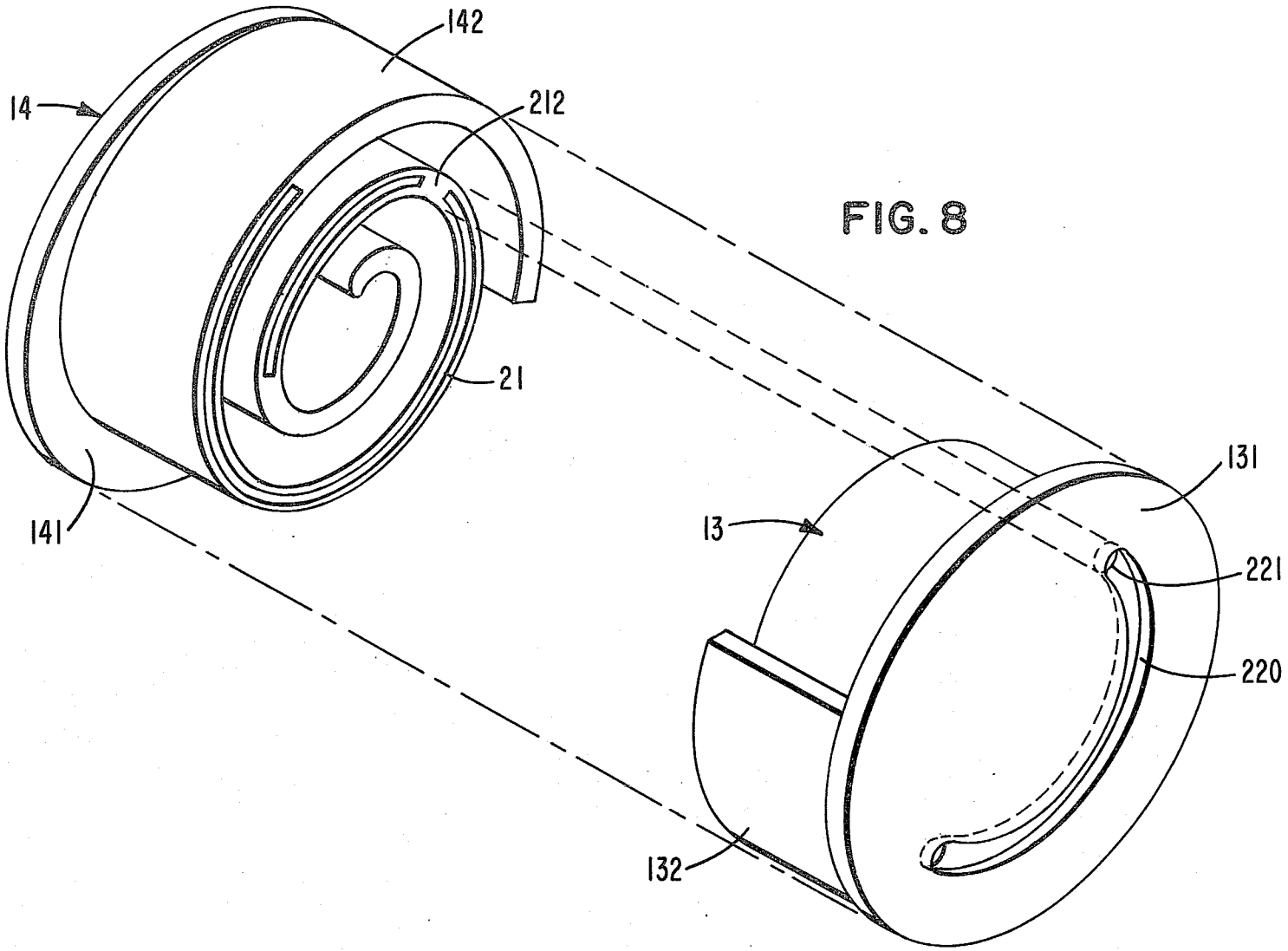
FIG. 8 is a perspective view of two interfitting scrolls according to the embodiment illustrated in FIG. 7.

FIG. 7 shows an alternative embodiment of the present invention which is used in combination with a modified end plate of the scroll members as illustrated in FIGS. 2–4 of U.S. patent application Ser. No. 277,109, filed on June 25, 1981, showing two holes in the end plate to permit fluid communication between the outer pockets of the scroll members, such as shown FIG. 1*a*, are hereby incorporated by reference. In other words, referring to FIG. 2 and FIG. 8 of this application, a channel 220 is formed between the outer portions of end plates 131 and 141 to permit fluid communication between the outer fluid pockets. In this modified end plate, it is desirable to position a closed portion 212 opposite the entrance 221 to the channels to prevent seal element 22 from interfering with the channel. Any interference with the channel would result in concentrated wear of the seal element 22.

According to this invention, the leakage of high pressure fluid along the groove in which the seal element is disposed is prevented by the closed portion of the groove. Therefore, axial sealing of the fluid pockets is assured, the deleterious effects of back pressure acting on the seal element are minimized to prevent concentrated wear of the seal element and volume efficiency is improved.

This invention has been described in detail in connection with the preferred embodiment, but these are merely examples only and this invention is not limited thereto. It will be easily understood by those skilled in the art that variations and modifications can be easily made within the scope of this invention.

We claim:

1. In a scroll type fluid compressor including a pair of scroll members each comprising an end plate and a spiral wrap extending from one side of said end plate, said spiral wrap having a groove formed in the axial end surface thereof along the spiral curve, said spiral wraps interfitting at an angular and radial offset to make a plurality of line contacts which define at least one pair of fluid pockets, drive means operatively connected to one of said scroll members for orbiting said one scroll member relative to the other scroll member and preventing rotation of said one scroll member to change the volume of the fluid pockets, the improvement comprising:

at least one closed portion intermediate the ends of said groove to divide said groove into at least two separate grooves to block fluid flow in said groove; and seal elements loosely fitted within said grooves on both sides of said closed portion, said closed portion preventing deformation and bending of said seal elements.

2. The scroll type fluid compressor of claim 1 wherein said line contacts define a small central pocket and a pair of outer fluid pockets which merge to form a new central pocket, said closed portion being located near a line contact of said scroll members at substantially the moment the small central pocket and the pair of outer fluid pockets merge.

3. The scroll type fluid compressor of claim 2 wherein said end plate of one of said scroll members has a channel and a second closed portion is formed on said spiral wrap of said other scroll member opposite the entrance to said channel.

4. In a scroll type fluid compressor including a pair of scroll members each comprising an end plate and a spiral wrap extending from one side of said end plate, said spiral wrap having a groove formed in the axial end surface thereof along the spiral curve, said spiral wraps interfitting at an angular and radial offset to make a plurality of line contacts which define at least one pair of fluid pockets, drive means operatively connected to one of said scroll members for orbiting said one scroll member relative to the other scroll member and preventing rotation of said one scroll member to change the volume of the fluid pockets, the improvement comprising:

at least one closed portion in said groove to block fluid flow in said groove;

a seal element loosely fitted within said groove;

said line contacts defining a small central pocket and a pair of outer fluid pockets which merge to form a new central pocket, said closed portion being located near a line contact of said scroll members at substantially the moment the small central pocket and the pair of outer fluid pockets merge; and said end plate of one of said scroll members having a channel and a second closed portion is formed on said spiral wrap opposite the entrance to said channel.

5. A scroll type fluid compressor comprising:

a compressor housing having a fluid inlet port and fluid outlet port;

a fixed scroll member fixedly disposed relative to said housing and having an end plate and a first spiral wrap extending from said end plate into the interior of said housing;

an orbiting scroll member having an end plate and a second spiral wrap extending therefrom, said first and second spiral wraps interfitting at an angular and radial offset to make a plurality of line contacts defining at least two fluid pockets which merge to form a single pocket;

driving means supported by said housing and connected to said orbiting scroll member for orbiting said orbiting scroll member and preventing the rotation of said orbiting scroll member to change the volume of the fluid pockets;

a groove formed in the axial end surface of said first and second spiral wraps along the spiral curve, said groove having at least one closed portion intermediate the ends of said groove to divide said groove into at least two separate grooves, said closed portion placed near a line contact of said scroll members at substantially the moment the fluid pockets merge; and seal elements loosely fitted within said grooves on both sides of said closed portion, said closed portion preventing deformation and bending of said elements.

6. A scroll type fluid compressor comprising:

a compressor housing having a fluid inlet port and fluid outlet port;

a fixed scroll member fixedly disposed relative to said housing and having an end plate and a first spiral wrap extending from said end plate into the interior of said housing;

an orbiting scroll member having an end plate and a second spiral wrap extending therefrom, said first and second spiral wraps interfitting at an angular and radial offset to make a plurality of line contacts defining at least two fluid pockets which merge to form a single pocket;

driving means supported by said housing and connected to said orbiting scroll member for orbiting said orbiting scroll member and preventing the rotation of said orbiting scroll member to change the volume of the fluid pockets;

a groove formed in the axial end surface of said first and second spiral wraps along the spiral curve, said groove having at least one closed portion placed near a line contact of said scroll members at substantially the moment the fluid pockets merge;

a seal elements loosely fitted within said grooves; and said end plate of said fixed scroll member having a channel and a second closed portion is formed in said spiral wrap of said orbiting scroll member opposite the entrance to said channel.

7. A scroll type fluid compressor comprising:

a compressor housing having a fluid inlet port and fluid outlet port;

a fixed scroll member fixedly disposed relative to said housing and having an end plate and a first spiral wrap extending from said end plate into the interior of said housing;

an orbiting scroll member having an end plate and a second spiral wrap extending therefrom, said first and second spiral wraps interfitting at an angular and radial offset to make a plurality of line contacts defining a small central pocket and at least two outer fluid pockets which merge to form a new central pocket;

driving means supported by said housing and connected to said orbiting scroll member for orbiting said orbiting scroll member and preventing the rotation of said orbiting scroll member to change the volume of the fluid pockets;

a groove formed in the axial end surface of said first and second spiral wraps along the spiral curve, and a seal element loosely fitted within said groove, said groove extending from an outer portion of said spiral wraps to an inner portion of said spiral wraps, said inner portion defined by the line contact of said scroll members at substantially the moment the fluid pockets merge so that the inner end of said groove prevents differential pressure between said central pocket and said outer fluid pockets from acting directly on said seal element.

* * * * *